US008033633B2

(12) United States Patent
Umeda

(10) Patent No.: US 8,033,633 B2
(45) Date of Patent: Oct. 11, 2011

(54) INKJET PRINTER AND INK CARTRIDGE

(75) Inventor: Takaichiro Umeda, Nagoya (JP)

(73) Assignee: Brother Kogyo Kabushiki Kaisha, Nagoya-shi, Aichi-Ken (JP)

( * ) Notice: Subject to any disclaimer, the term of this patent is extended or adjusted under 35 U.S.C. 154(b) by 149 days.

(21) Appl. No.: 12/033,228

(22) Filed: Feb. 19, 2008

(65) Prior Publication Data

US 2008/0198188 A1 Aug. 21, 2008

(30) Foreign Application Priority Data

Feb. 19, 2007 (JP) ..... 2007-038443

(51) Int. Cl.
*B41J 29/393* (2006.01)

(52) U.S. Cl. ..... 347/19

(58) Field of Classification Search ..... None
See application file for complete search history.

(56) References Cited

U.S. PATENT DOCUMENTS

| | | | | |
|---|---|---|---|---|
| 2006/0203017 | A1* | 9/2006 | Eguchi et al. | 347/7 |
| 2007/0087311 | A1* | 4/2007 | Garvey et al. | 434/21 |
| 2007/0107801 | A1* | 5/2007 | Cochran et al. | 141/153 |

FOREIGN PATENT DOCUMENTS

| | | | |
|---|---|---|---|
| JP | 01-048241 | A | 2/1989 |
| JP | H06-106730 | A | 4/1994 |
| JP | H11-240167 | A | 9/1999 |
| JP | 2004-142325 | A | 5/2004 |
| JP | 2006-116785 | A | 5/2006 |
| WO | 2006-043718 | A1 | 4/2006 |

OTHER PUBLICATIONS

Translation of JP 2004-142325 A.*

* cited by examiner

*Primary Examiner* — Matthew Luu
*Assistant Examiner* — Justin Seo
(74) *Attorney, Agent, or Firm* — Baker Botts L.L.P.

(57) ABSTRACT

An inkjet printer is provided. The inkjet printer includes: a holder configured to mount thereon an ink cartridge for storing ink; and an imaging unit which obtains an image of a surface of the ink in the ink cartridge mounted on the holder.

16 Claims, 7 Drawing Sheets

INKJET PRINTER AND INK CARTRIDGE

CROSS-REFERENCE TO RELATED APPLICATION

This application claims priority from Japanese Patent Application No. 2007-038443, filed on Feb. 19, 2007, the entire subject matter of which is incorporated herein by reference.

TECHNICAL FIELD

Aspects of the present invention relate to an inkjet printer which carrying out printing by ejecting inks, and to an ink cartridge to be mounted thereon.

BACKGROUND

An inkjet printer carries out printing by ejecting inks from nozzles onto a recording sheet. A known inkjet printer is configured to mount thereon an ink cartridge storing an ink. Another known inkjet printer is capable of detecting and monitoring a remaining amount of ink in the ink cartridge.

JP-A-6-106730 describes an inkjet printer including an inkjet printer body, ink tanks (ink cartridges) which stores inks, respectively, a carriage on which the ink tanks are mounted, and a lever which locates and retains the ink tanks at and on the carriage. Each of the ink tanks is formed of a transparent material such that the inside of the ink tank is viewable from the outside. The lever has an opening formed therethrough. Also, the inkjet printer body has an opening formed therethrough at a position facing the carriage when the carriage is located at a predetermined position out of a recording region, e.g., a home position, during a non-printing time or the like. According to this configuration, even in a state in which the ink tanks are retained to the carriage by the lever, it is possible for a user to visually check remaining amounts of inks in the ink tanks, respectively, through the opening of the inkjet printer body and the opening of the lever.

However, in the above-described inkjet printer, it may be difficult to visually check the remaining amounts of inks via the openings from the outside, depending on the positions of the openings. When the ink tanks are attempted to be provided at a position easily viewable from the outside, the flexibility in layout of the ink tanks in the printer is decreased. Moreover, during printing, because the carriage on which the ink tanks are mounted is away from the home position, it is impossible to check remaining amounts of inks in the ink tanks through the openings. Additionally, it may be not advantageous in appearance that an opening is provided to the printer body, through which an interior of the inkjet printer can always be seen.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an inkjet printer, in which it is possible to easily check a remaining amount of ink in an ink cartridge, and to provide an ink cartridge.

According to an exemplary embodiment of the present invention, there is provided an inkjet printer comprising: a holder configured to mount thereon an ink cartridge for storing an ink; and an imaging unit which obtains an image of a surface of the ink in the ink cartridge mounted on the holder.

According to another exemplary embodiment of the present invention, there is provided an inkjet printer comprising: a holder configured to mount thereon an ink cartridge for storing an ink; and an illumination unit configured to illuminates an inside of the ink cartridge mounted on the holder.

According to another exemplary embodiment of the present invention, there is provided an ink cartridge which is mountable on a holder of an inkjet printer, the ink cartridge comprising: a case for storing an ink, the case including a bottom surface which is located at bottom when the ink cartridge is mounted on the holder, wherein the bottom surface has a color corresponding to a color of the ink.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

First Exemplary Embodiment

Hereinafter, a first exemplary embodiment of the present invention will be described with reference to the drawings. The first exemplary embodiment describes an inkjet printer as one example to which the inventive concept of the present invention is applied to, and which ejects ink onto a recording sheet to record desired characters, images, and the like.

Figure 1:
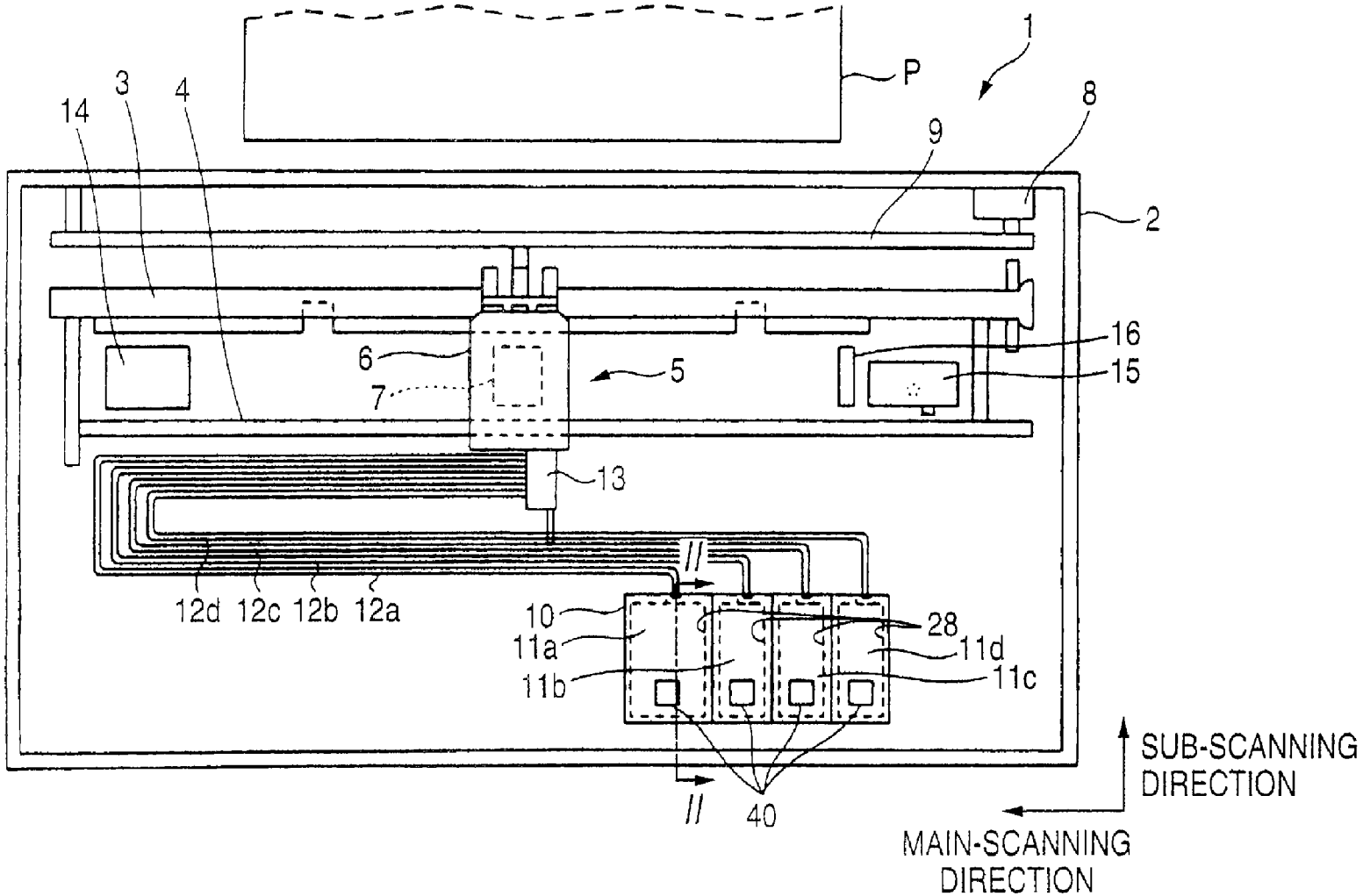
FIG. 1 is a schematic plan view of an inkjet printer according to a first exemplary embodiment of the present invention.

As shown in FIG. 1, an inkjet printer 1 includes two guide shafts 3 and 4 extending in a main-scanning direction in a frame 2. A carriage 5 is slidably mounted to the two guide shafts 3 and 4 such that the carriage 5 reciprocates in the main-scanning direction. The carriage 5 has a head holder 6. Further, a carriage motor 8 is installed in the frame 2, and an endless belt 9 is wrapped around a drive shaft of the carriage motor B. The head holder 6 is coupled with the endless belt 9, and when the endless belt 9 is driven by the carriage motor 8, the head holder 6 reciprocates in the main-scanning direction. An inkjet head 7 having a plurality of nozzles (not shown) are held by the head holder 6. The inkjet head 7 ejects inks from the nozzles onto a printing sheet P conveyed by a conveying mechanism 80 (refer to FIG. 3) under the carriage 5 to carry out printing.

Moreover, the inkjet printer 1 includes an ink absorption member 14 to absorb inks ejected from the nozzles of the inkjet head 7 at the time of flushing, and the ink absorption member 14 is positioned at one end of the frame 2 in the main scanning direction (on the left side in FIG. 1). On the other hand, a purge mechanism 15 to draw inks from the nozzles at the time of purging is provided at the other end of the frame 2 in the main scanning direction (on the right side in FIG. 1), and a wiper 16 to wipe inks adhered to the nozzle faces is provided on the left side of the purge mechanism 15.

Additionally, a holder 10 having four cartridge mounting sections 28 aligned in the main-scanning direction is fixed to the bottom of the frame 2, and ink cartridges 11*a*, 11*b*, 11*c*, and 11*d* are removably mounted to the four cartridge mounting sections 28, respectively. A black ink, a yellow ink, a magenta ink, and a cyan ink are respectively stored in these ink cartridges 11*a* to 11*d*. The ink cartridges 11*a* to 11*d* are respectively connected to tube joints 13 provided at the carriage 5 via flexible tubes 12*a* to 12*d*. The tube joints 13 are connected to the inkjet head 7, and the inks in the ink cartridges 11*a* to 11*d* are respectively supplied to the inkjet head 7 through the tube joints 13.

Then, the inkjet printer 1 is configured to record images and the like on the recording sheet P by ejecting the four-color inks from the plurality of nozzles of the inkjet head 7 onto the recording sheet P conveyed by the conveying mechanism 80 while moving the inkjet head 7 along with the carriage 5 in the main-scanning direction.

Next, the holder 10 and the ink cartridges 11*a* to 11*d* will be described with reference to FIG. 2. Herein, since all four ink cartridges 11*a* to 11*d* respectively storing the tour-color inks have the same structure, the description of the ink cartridge 11*a* in which the black ink is stored will be given, and the descriptions of the other ink cartridges 11*b* to 11*d* will be omitted.

First, the ink cartridge 11*a* will be described. As shown in FIG. 2, the ink cartridge 11*a* has a substantially rectangular parallelepiped case 60 made of synthetic resin having translucency. The case 60 includes a hollow ink tank 30 formed therein, and the ink tank 30 stores ink. Since the case 60 has translucency, it is possible to visually check the ink stored in the ink tank 30 from the outside. The case 60 has a leading wall, and the ink cartridge 11*a* is mounted onto the holder 10 from the leading wall in a mounting direction. Further, the case 60 has an ink outlet part 31 and an air supply part 32. The ink outlet part 31 has a hole formed through a lower portion of the leading wall of the case 60, and the ink in the ink tank 30 can flow out through the hole. In other words, the ink outlet part 31 is provided at the lower portion of the leading wall. The air supply part 32 has a hole formed through an upper portion of the leading wall of the case 60, and the air can flow into the ink tank 30 through the hole.

The ink tank 30 includes a sensor arm 70 therein. The sensor arm 70 is made of resin which blocks light. Specifically, the sensor arm 70 is made of a material whose specific gravity is less than the specific gravity of the ink. The sensor arm 70 includes a light blocking plate 71 at one end thereof, a float 73 at the other end, and a joining member 75 which joins the light blocking plate 71 and the float 73. Moreover, the ink tank 30 includes stoppers 34 and 35 housed therein. The stoppers 34 and 35 are provided on the inner surface of the leading wall of the case 60, and are disposed above and below the light blocking plate 71, respectively. A vertical movement of the light blocking plate 71 is limited between the stoppers 34 and 35.

An attachment shaft 77 is formed at the joining member 75. The attachment shaft 77 extends in a direction perpendicular to the sheet of FIG. 2, and both ends of the attachment shaft 77 are respectively supported by substantially U-shaped arm supporting members 33 provided at inner wall surfaces of the ink tank 30, respectively, such that the sensor arm 70 is capable of pivoting about the attachment shaft 77. The light blocking plate 71 is located between the two stoppers 34 and 35, and the float 73 is located in the vicinity of the bottom of the ink tank 30.

Further, a volume ratio of the float 73 to the entirety of the sensor arm 70 is sufficiently great, and the volume from the attachment shaft 77 to the float 73 is sufficiently greater than the volume from the attachment shaft 77 to the light blocking plate 71. Specifically, these volume ratios are set such that a clockwise moment generated in the sensor arm 70 by a gravitational force and a buoyancy force acting on the sensor arm 70 is made greater than an counterclockwise moment generated in the sensor arm 70 by the gravitational force and the buoyancy force acting on the sensor arm 70 in FIG. 2 when the float 73 is located within the ink, and the clockwise moment and the counterclockwise moment are made equal to each other when a part of the float 73 is exposed from the ink surface.

Accordingly, when ink is sufficiently stored in the ink tank 30, the clockwise moment is applied to the sensor arm 70, and the light blocking plate 71 contacts the stopper 35. Thereafter, the ink surface is lowered and a part of the float 73 is exposed from the ink surface in accordance with a decrease in the ink in the ink tank 30. When the ink surface is further lowered in accordance with the decrease in the ink, the float 73 moves downward so as to follow the ink surface. When the float 73 moves downward, the sensor arm 70 pivots about the attachment shaft 77, and the light blocking plate 71 moves toward the stopper 34 and contacts the stopper 34.

Next, the holder 10 will be described. The holder 10 is fixed to a bottom 2*a* of the frame 2. A cover 24 is attached to one end of the bottom 2*a* so as to pivot between a closed position to cover the holder 10 and an open position to expose the holder 10 to the outside. The cover 24 pivots about a lower end portion thereof to open to allow the ink cartridge 11*a* to be mounted onto and removed from the cartridge mounting section 28 of the holder 10. A cover opening and closing detection sensor 25 is provided on an inner side of the cover 24 so as to contact an upper end of the cover 24 at the closed position. It is detected whether the cover 24 is opened or closed by the cover opening and closing detection sensor 25 detecting whether or not a leading end portion 25*a* of the detection sensor 25 contacts the cover 24.

Each of the four cartridge mounting sections 28 of the holder 10 is formed in a concave shape having an open end and a closed end. Further, as shown in FIG. 1, the cartridge mounting sections 28 adjacent to one another are partitioned with partition walls. The ink cartridge 11*a* is mounted onto the cartridge mounting section 28 in the mounting direction from the open end of the cartridge mounting section 28, i.e., from the left end of the cartridge mounting section 28 in FIG. 2. Further, the holder 10 includes an imaging unit, e.g., a camera 40, an optical sensor 18, an ink supply hole 19, an air supply hole 20, and a cover unit 21.

The camera 40 is attached to a shaft 41 positioned at an upper wall portion 10*a* of the holder 10, and is located above the ink cartridge 11*a* when the ink cartridge 11*a* is mounted on the cartridge mounting section 28. The camera 40 is configured to pivot about the shaft 41. Further, as shown in FIG. 1, the four cameras 40 are respectively provided to the four cartridge mounting sections 28. The camera 40 is capable of imaging the ink surface in the ink cartridge 11*a* in a wide range, e.g., capable of imaging an ink surface in the vicinity of the sensor arm 70 and an ink surface in the vicinity of the ink outlet part 31, by pivoting about the shaft 41. The camera 40 includes an imaging portion 42, a lens driving mechanism 43, and an illumination unit 44 (refer to FIG. 3). The imaging portion 42 obtains an image of the ink surface in the ink cartridge 11*a* as an imaging object. The lens driving mechanism 43 has a zoom function to vary a focal length of a lens. In accordance with this configuration, the imaging portion 42 is capable of obtaining an enlarged image of ink surface. The illumination unit 44 illuminates the inside of the ink cartridge 11*a* from above when the imaging portion 42 obtains the image. The camera 40 may not obtain an image of the ink surface, facing vertically downward, but may obtain an image of the ink surface in the vicinity of the ink outlet part 31, facing a direction inclined at a predetermined angle from the vertical direction by pivoting about the shaft 41. Therefore, light emitted from the illumination unit 44 and reflected at the ink surface is not directed toward the camera 40, and the camera 40 can obtain an image which is easy to visually check without disturbance of the reflected light.

The ink supply hole 19 extends in a horizontal direction through a lower portion of a side wall portion 10*b* of the holder 10. The side wall portion 10*b* is positioned at the closed end of the cartridge mounting section 28. One end of the ink supply hole 19 is communicated with the ink outlet part 31 of the ink cartridge 11*a* when the ink cartridge 11*a* is mounted on the cartridge mounting section 28. The other end of the ink supply hole 19 communicates with an ink flow path in the inkjet head 7 through a tube 12*a*. According to this configuration, the ink led out of the ink cartridge 11*a* via the ink outlet part 31 from the inside of the ink tank 30 is supplied to the inside of the inkjet head 7 via the ink supply hole 19 and the tube 12*a*.

The air supply hole 20 extends in the horizontal direction through an upper portion of the side wall portion 10*b* of the holder 10. One end of the air supply hole 20 communicates with the air supply part 32 of the ink cartridge 11*a* when the ink cartridge 11*a* is mounted on the cartridge mounting section 28 and supplies the air to the air supply part 32 of the ink cartridge 11*a*.

The cover unit 21 is pivotably attached to a bottom wall portion 10*c* of the holder 10 so as to move between a closed position to cover the open end of the cartridge mounting section 28 and an open position to expose the open end of the cartridge mounting section 28. Specifically, the cover unit 21 includes a cover unit body 21*b* pivotably attached to the bottom wall portion 10*c* of the holder 10 at one end thereof, an extending portion 21*a* extending in a direction perpendicular to the cover unit body 21*b* from the other end of the cover unit body 21*b*, a convex portion 21*c* formed at a leading end portion of the extending portion 21*a*, and convex portions 21*d* formed at an inner surface (a surface covering the ink cartridge 11*a*) of the cover unit body 21*b*. When the ink cartridge 11*a* is mounted on the cartridge mounting section 28, and the cover unit 21 pivots to the closed position, the convex portion 21*c* is engaged with a concave part 10*d* of the holder 10. When this occurs, the convex portions 21*d* press the ink cartridge 11*a* in the mounting direction so that the ink supply hole 19 of the holder 10 and the ink outlet part 31 of the ink cartridge 11*a* are coupled to communicate with each other with no gap therebetween. Similarly, the air supply hole 20 of the holder 10 and the air supply part 32 of the ink cartridge 11*a* are coupled to communicate with each other with no gap therebetween. In this way, the ink cartridge 11*a* is retained in the cartridge mounting section 28.

Figure 2:
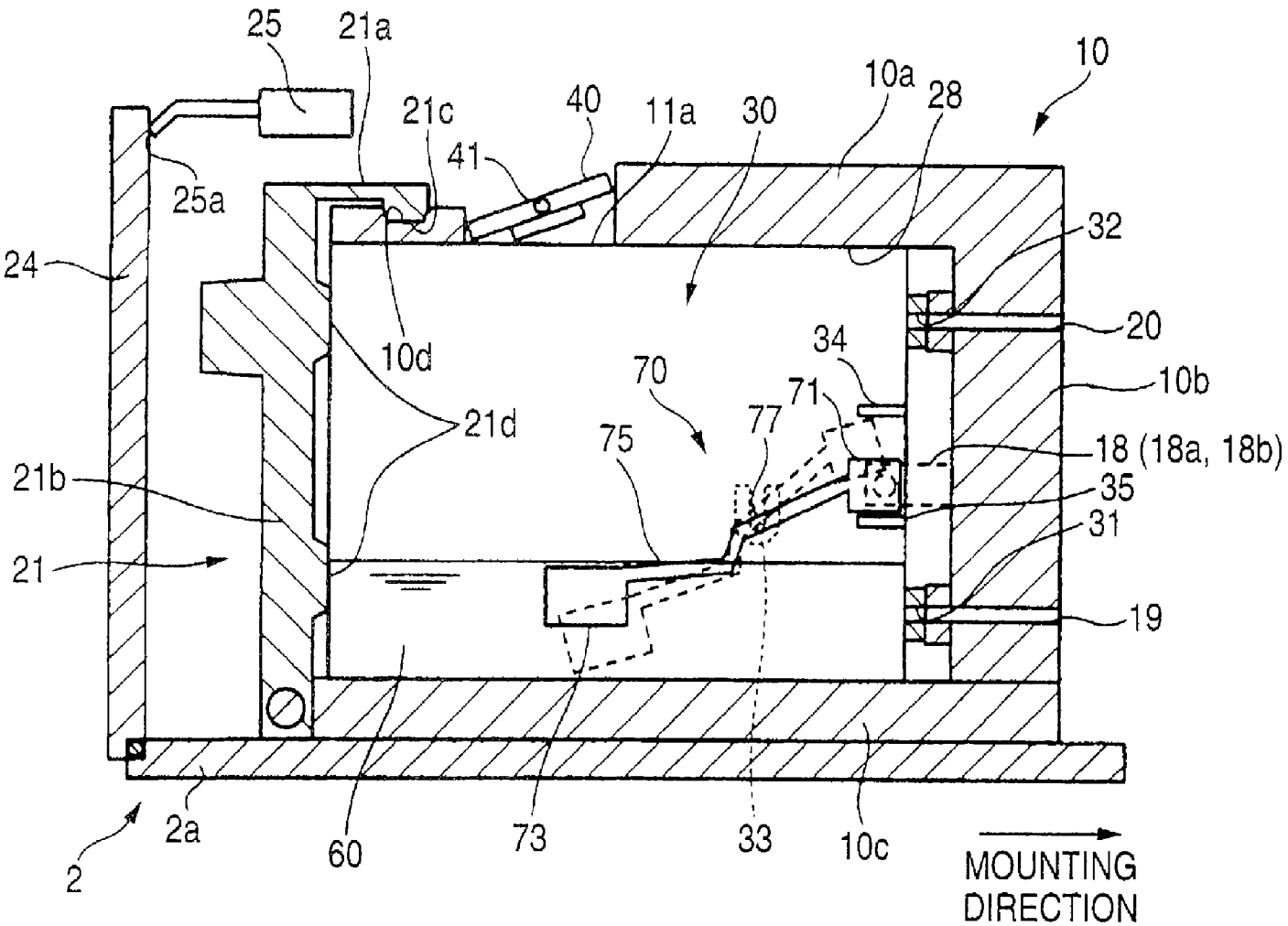
FIG. 2 is across-sectional view taken along line II-II in FIG. 1.

The optical sensor 18 is provided at the substantially center of the side wall portion 10*b* of the holder 10 in height so as to sandwich the both side surfaces of the ink cartridge 11*a* (surfaces at the front side and the opposite side of the sheet of FIG. 2). The optical sensor 18 is configured to detect a remaining amount of ink in the ink cartridge 11*a*.

The optical sensor 18 has a light emitting element 18*a* facing one of the side surfaces of the ink cartridge 11*a*, and a light receiving element 18*b* facing the other of the side surfaces of the ink cartridge 11*a*. The ink cartridge 11*a* is inserted between the light emitting element 18*a* and the light receiving element 18*b* when the ink cartridge 11*a* is mounted on the cartridge mounting section 28. The light emitting element 18*a* is connected to a controller 50 which will be described later, and emits light in accordance with a control signal from the controller 50. The light receiving element 18*b* as well is connected to the controller 50, and transmits a signal to the controller 50 when receiving light.

When ink is sufficiently stored in the ink tank 30, the light blocking plate 71 is located on a virtual straight line connecting the light emitting element 18*a* and the light receiving element 18*b* respectively. That is, light emitted from the light emitting element 18*a* is blocked by the light blocking plate 71 and is not received by the light receiving element 18*b*. Thereafter, after the ink surface has been lowered such that a part of the float 73 is exposed from the ink surface in accordance with a decrease in the ink in the ink tank 30, when the ink liquid surface is lowered in accordance with the decrease in the ink, the float 73 moves downward so as to follow the ink surface. When the float 73 moves downward, the sensor arm 70 pivots about the attachment shaft 77, and the light blocking plate 71 moves toward the stopper 34 which is located above the light blocking plate 71. When this occurs, the light blocking plate 71 is not located on the virtual straight line connecting the light emitting element 18*a* and the light receiving element 18*b*, and the light emitted from the light emitting element 18*a* is received by the light receiving element 18*b*. Accordingly, it is possible to detect that, when the light receiving element 18*b* does not receive the light emitted from the light emitting element 18*a*, the ink is sufficiently stored, and when the light receiving element 18*b* receives the light emitted from the light emitting element 18*a*, the ink is not sufficient.

Figure 3:
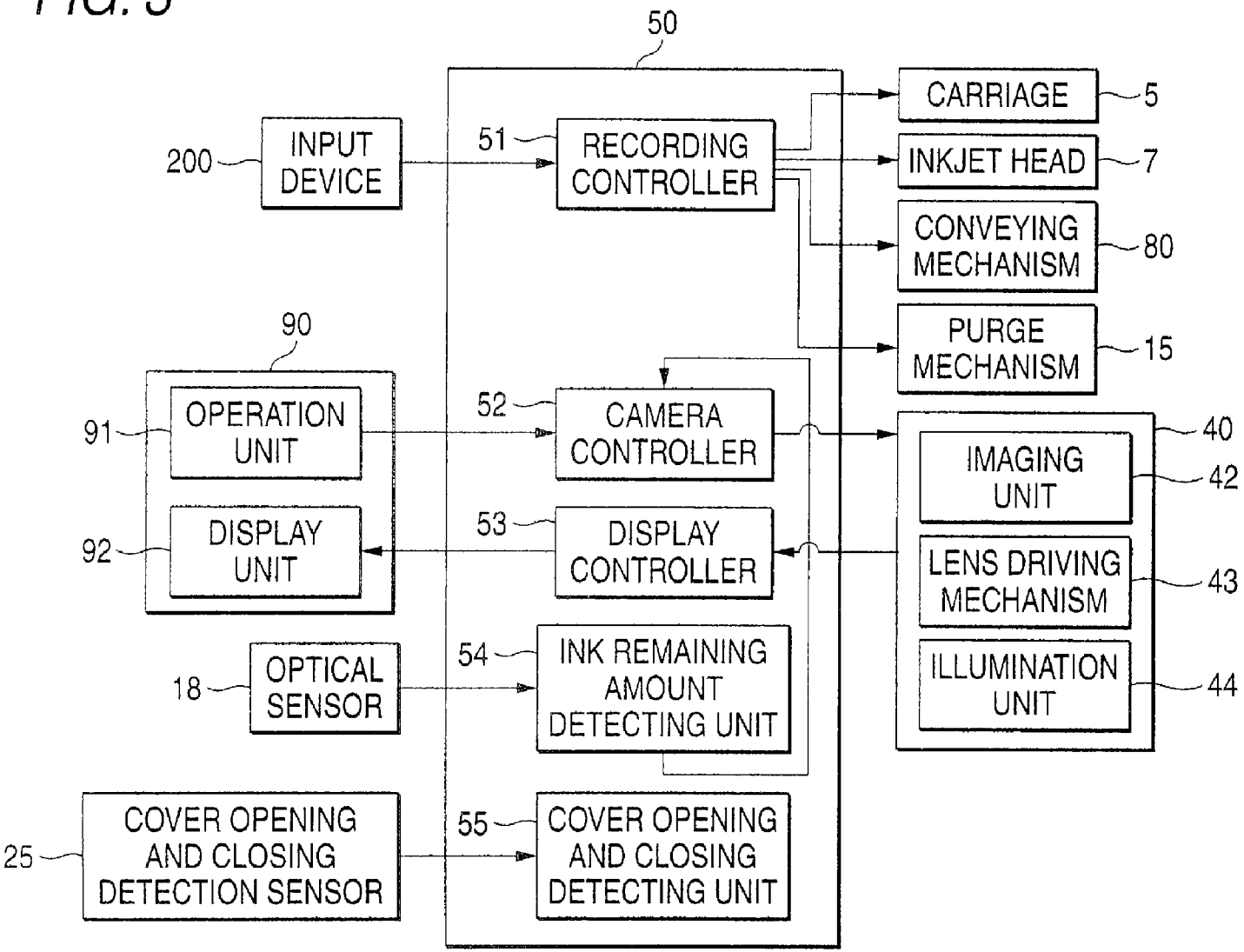
FIG. 3 is a block diagram showing an electrical configuration of the inkjet printer.

Next, an electrical configuration of the inkjet printer 1 will be described with reference to FIG. 3. As shown in FIG. 3, the inkjet printer 1 includes the controller 50 controlling the entire operations. The controller 50 includes a central processing unit (CPU), a read only memory (ROM) which stores various programs, data, and the like for controlling the entire operations of the inkjet printer 1, a random access memory (RAM) which temporarily stores data and the like processed in the CPU, an input and output interface, and the like.

The controller 50 includes a recording controller 51, a camera controller 52, a display controller 53, an ink remaining amount detecting unit 54, and a cover opening and closing detecting unit 55.

When information such as print data is inputted from an input device 200 such as a Personal Computer, the recording controller 51 controls the inkjet head 7, the carriage 5, and the conveying mechanism 80 to record characters, images, and the like onto the recording sheet P, based on the print data. The recording operation is performed by moving the inkjet head 7 along with the carriage 5 and ejecting ink droplets onto the recording sheet P from the plurality of nozzles of the inkjet head 7 while controlling the conveying mechanism 80 to convey the recording sheet P in a sheet conveying direction. Further, the recording controller 51 controls the purge mechanism 15 to perform purging in which inks are drawn from the nozzles of the inkjet head 7, when a command to perform purging is inputted from the input device 200.

When an operation unit 91 of an operation panel 90 which will be described later is operated by a user, and a control signal to perform obtaining images of ink surfaces in the ink cartridges 11*a* to 11*d* by the cameras 40 is inputted, the camera controller 52 controls the imaging portion 42 of each camera 40 to obtain an image. At this time, the control signal is inputted to each imaging portion 42 from the camera controller 52 to obtain an image, and as synchronized therewith, each illumination unit 44 is controlled to illuminate the inside of a corresponding one of the ink cartridge 11*a* to 11*d*.

The display controller 53 controls a display unit 92, which will be described later, to display the images of the ink surfaces obtained by the imaging portions 42 of the cameras 40, respectively.

The ink remaining amount detecting unit 54 detects whether or not a sufficient amount of ink remains in the ink tank 30 on the basis of a signal outputted from the optical sensor 18.

The cover opening and closing detecting unit 55 detects whether the cover 24 is opened or closed by the cover opening and closing detection sensor 25 detecting whether or not the leading end portion 25*a* of the detection sensor 25 contacts the cover 24.

Figure 4:
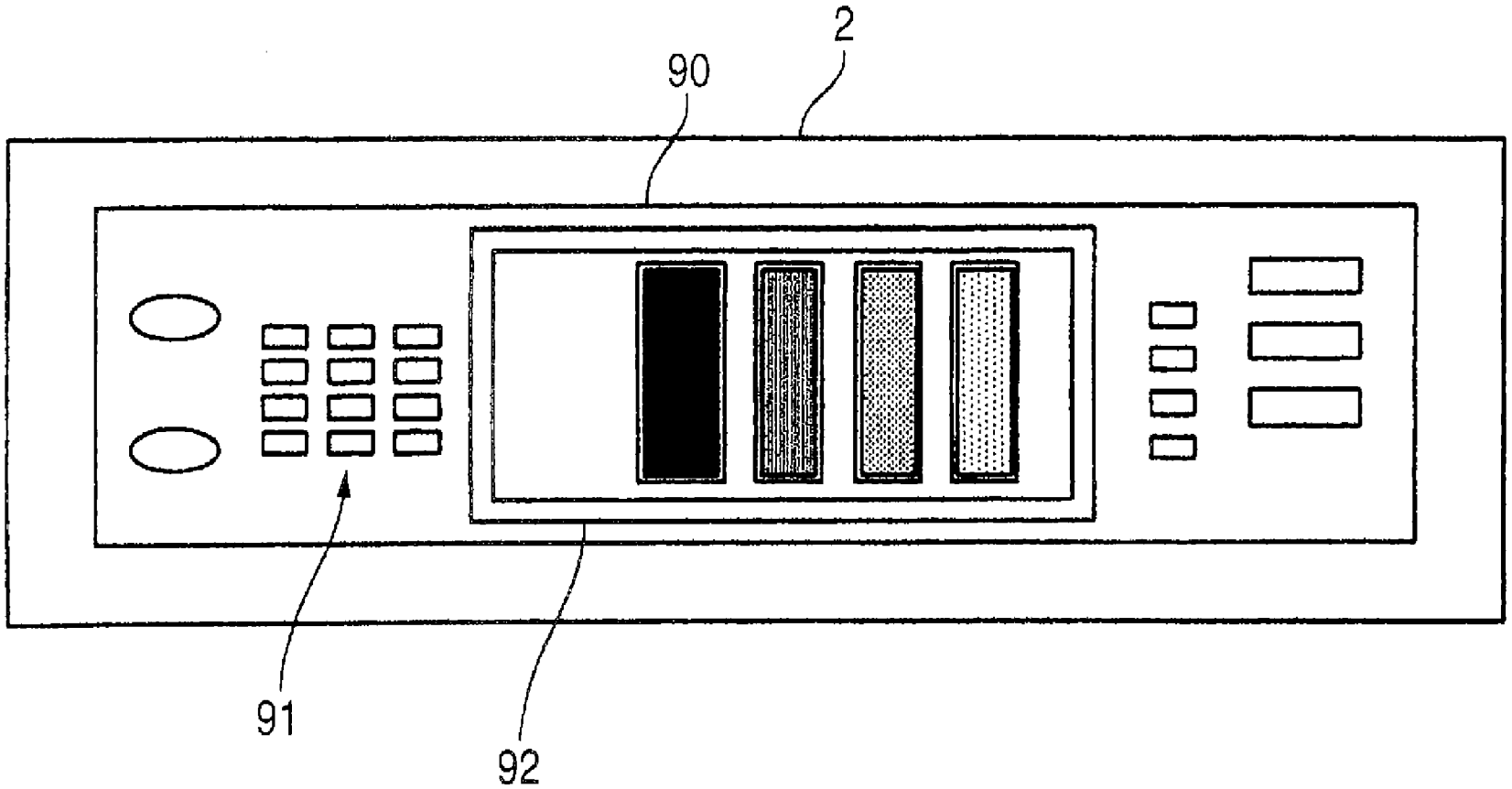
FIG. 4 is a plan view of an operation panel.

Next, a detailed configuration of the operation panel 90 including the operation unit 91 and the display unit 92 will be described with reference to FIG. 4. As shown in FIG. 4, the operation panel 90 is provided to the frame 2, and includes the display unit 92 and the operation panel 90, and the like. The display unit 92 is constituted of a liquid crystal panel and the like and displays information on printing, e.g., an error message, sheet size setting items, and the like. Moreover, the display unit 92 displays the images of ink surfaces in the ink cartridges 11*a* to 11*d* obtained by the cameras 40, respectively. The operation unit 91 is constituted of various buttons and the like, and inputs various commands by being operated by a user.

Here, a series of operations relating to obtaining an image will be described. First, in order to obtain images of ink liquid surfaces in the ink cartridges 11*a* to 11*d* by the cameras 40, respectively, a user operates the operation unit 91 of the operation panel 90. Then, the camera controller 52 controls the illumination units 44 to illuminate the insides of the ink cartridges 11*a* to 11*d*, respectively, and controls the imaging portions 42 to obtain images of the ink surfaces, respectively. Then, the display controller 53 controls the display unit 92 to display the images of ink surfaces obtained by the imaging portions 42, respectively. When it is difficult to visually check the ink surfaces in the images displayed on the display unit 92, the user can make the cameras 40 pivot by operating the operation unit 91, and adjusts the positions of the cameras 40 such that the cameras 40 can obtain the images of ink surfaces which are easy to check visually. Here, when the ink remaining amount detecting unit 54 detects that a remaining amount of ink in one of the ink cartridges 11*a* to 11*d* is less than a predetermined amount with the optical sensor 18, the camera controller 52 controls the imaging portion 42 to obtain an enlarged image of the ink surface in the vicinity of the ink outlet part 31 by varying a focal length with the lens driving unit 43.

As described above, in the inkjet printer 1 according to the first exemplary embodiment, by displaying the images of ink surfaces obtained by the cameras 40 on the display unit 92 when the ink cartridges 11*a* to 11*d* are mounted on the holder 10, it is possible to easily check the remaining amounts of inks in the ink cartridges 11*a* to 11*d*, respectively, without removing the ink cartridges 11*a* to 11*d* from the holder 10. That is, there is no need to remove the ink cartridges 11*a* to 11*d* for checking the remaining amounts, and the problem of air entering into an ink supply path between the ink cartridges 11*a* to 11*d* to the inkjet head 7 due to the removal of the ink cartridges 11*a* to 11*d* is not caused. Further, because it is possible to check the remaining amounts of inks in the ink cartridges 11*a* to 11*d* regardless of the layout of the ink cartridges 11*a* to 11*d* in the inkjet printer 1, the flexibility in the layout of the ink cartridges 11*a* to 11*d* becomes higher.

Further, the camera 40 is provided to the holder 10, and obtains an image of the ink surface in the vicinity of the ink outlet part 31 at which last ink remains when ink is consumed from the ink outlet part 31. Therefore, even when the remaining amount of ink is very low, it is possible to reliably check whether enough ink remains for the inkjet printer 1 to carry out the printing. Moreover, since the camera 40 obtains an enlarged image of the ink surface in the vicinity of the ink outlet part 31 by driving the lens driving mechanism 43 when it is detected that the remaining amount of ink is low by the optical sensor 18, it is possible to check more easily whether enough ink remains for the inkjet printer 1 to carry out the printing.

Further, since the holder 10 is fixed to the frame 2, and the ink cartridges 11*a* to 11*d* are not mounted on the carriage 5, it may be difficult to visually check the remaining amounts of inks in the ink cartridges 11*a* to 11*d* directly from the outside. However, it is possible for the user to easily check remaining amounts of inks in the ink cartridges 11*a* to 11*d* by obtaining the images of ink surfaces by the cameras 40, respectively. Moreover, since the inkjet printer 1 has the display unit 92 in the operation panel 90, it is possible to display images obtained by the cameras 40, not on an external device such as a Personal Computer, but on the display unit 92. In accordance with this configuration, it is possible to easily check the remaining amounts of inks while operating the inkjet printer 1. Further, there is provided the illumination unit 44 illuminating the ink surface in synchronized with the operation of the camera 40, when the operation unit 91 is operated by a user and a control signal is inputted for the camera 40 to perform imaging. By illuminating the ink surfaces by the illumination units 44, it is easy for the user to visually check the ink surfaces in the images obtained by the cameras 40, respectively. Therefore, it is possible to check the remaining amounts of the inks more easily. Further, since the camera 40 is capable of obtaining an image of the sensor arm 70 itself, even when the sensor arm 70 does not pivot due to some troubles occurring in the sensor arm 70, and therefore the controller 50 cannot recognize that remaining amount of ink is low, it is possible to visually check that the remaining amount of ink is low and the troubles are occurring in the sensor arm 70. Therefore, it is easy to prevent the inkjet printer 1 from carrying out the printing without inks in the ink cartridge 10*a* to 10*d*.

Second Exemplary Embodiment

Next, a second exemplary embodiment of the present invention will be described with reference to FIG. 5. In this exemplary embodiment, only the configurations of the holder 10 and the camera 40 are different, and the others are the same as those in the first exemplary embodiment. Accordingly, components which are the same as those in the first exemplary embodiment are denoted by same reference numerals, and descriptions thereof will be omitted.

Figure 5:
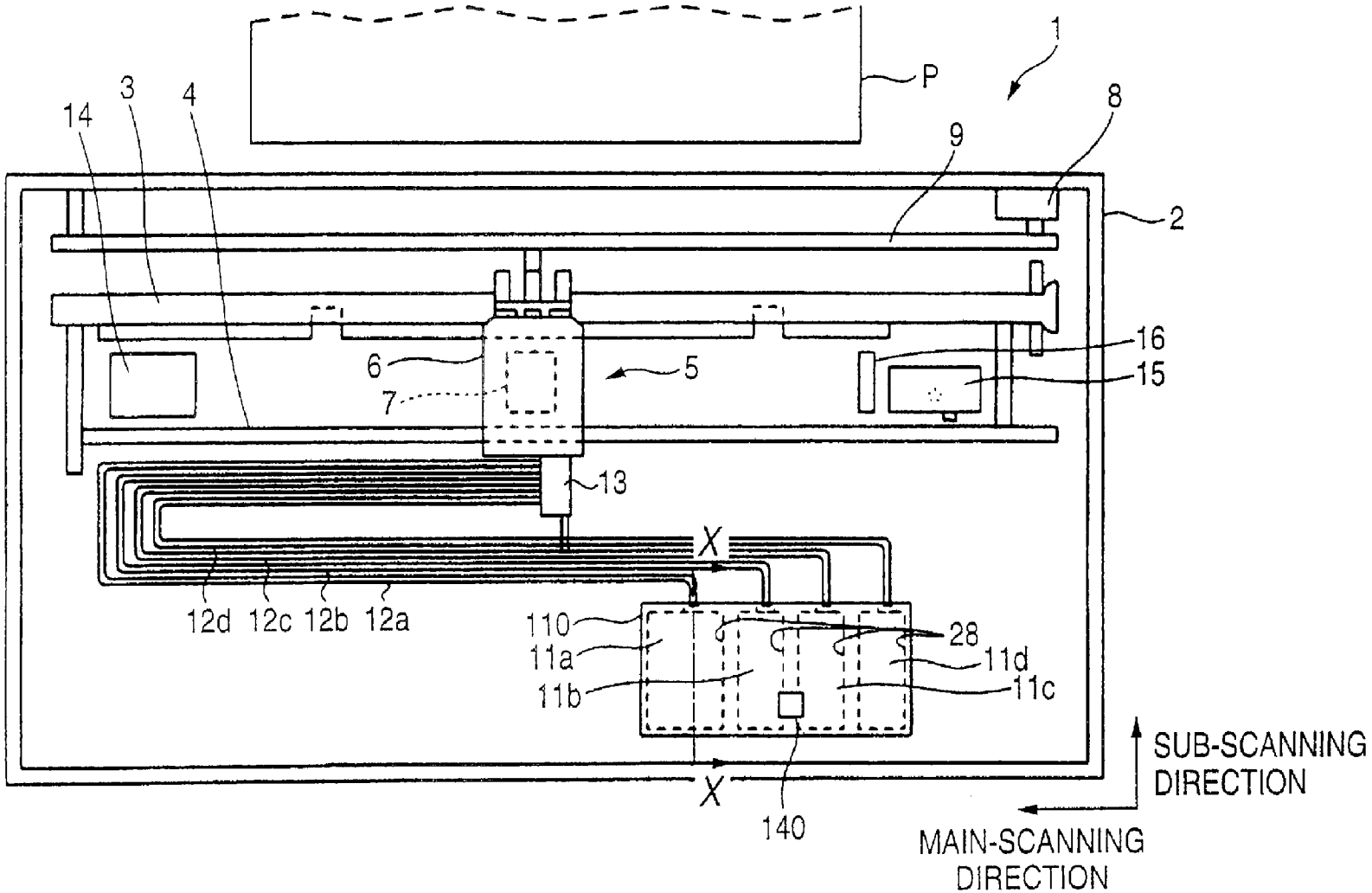
FIG. 5 is a schematic plan view of an inkjet printer according to a second exemplary embodiment of the present invention.

As shown in FIG. 5, a holder 110 is different from the holder 10 according to the first exemplary embodiment, and does not have partition walls to partition the cartridge mounting sections 28 adjacent to each other. A single camera 140 is attached to the holder 110 at the substantially center part in the main-scanning direction of the four cartridge mounting sections 28. A wide angle lens whose view angle is wide is used as this camera 140. The camera 140 obtains an image of all the ink surfaces in the ink cartridges 11*a* to 11*d* housed in the holder 10. In accordance with this configuration, since an image of the ink surfaces in the four ink cartridges 11*a* to 11*d* can be obtained at one time, it is possible to check the remaining amounts of inks in the ink cartridges 11*a* to 11*d* at the same time. Further, the number of camera is less compared to the first exemplary embodiment. Therefore, cost can be reduced. It is noted that the holder 110 may have partition walls to partition the cartridge mounting sections 28 adjacent to each other. In this case, the partition walls may be formed of transparent material in order for the camera 140 to be able to obtain an image of all the ink surfaces in the ink cartridges 11*a* to 11*d*.

While the present invention has been shown and described with reference to certain exemplary embodiments thereof, it will be understood by those skilled in the art that various changes in form and details may be made therein without departing from the spirit and scope of the invention as defined by the appended claims.

Figure 6:
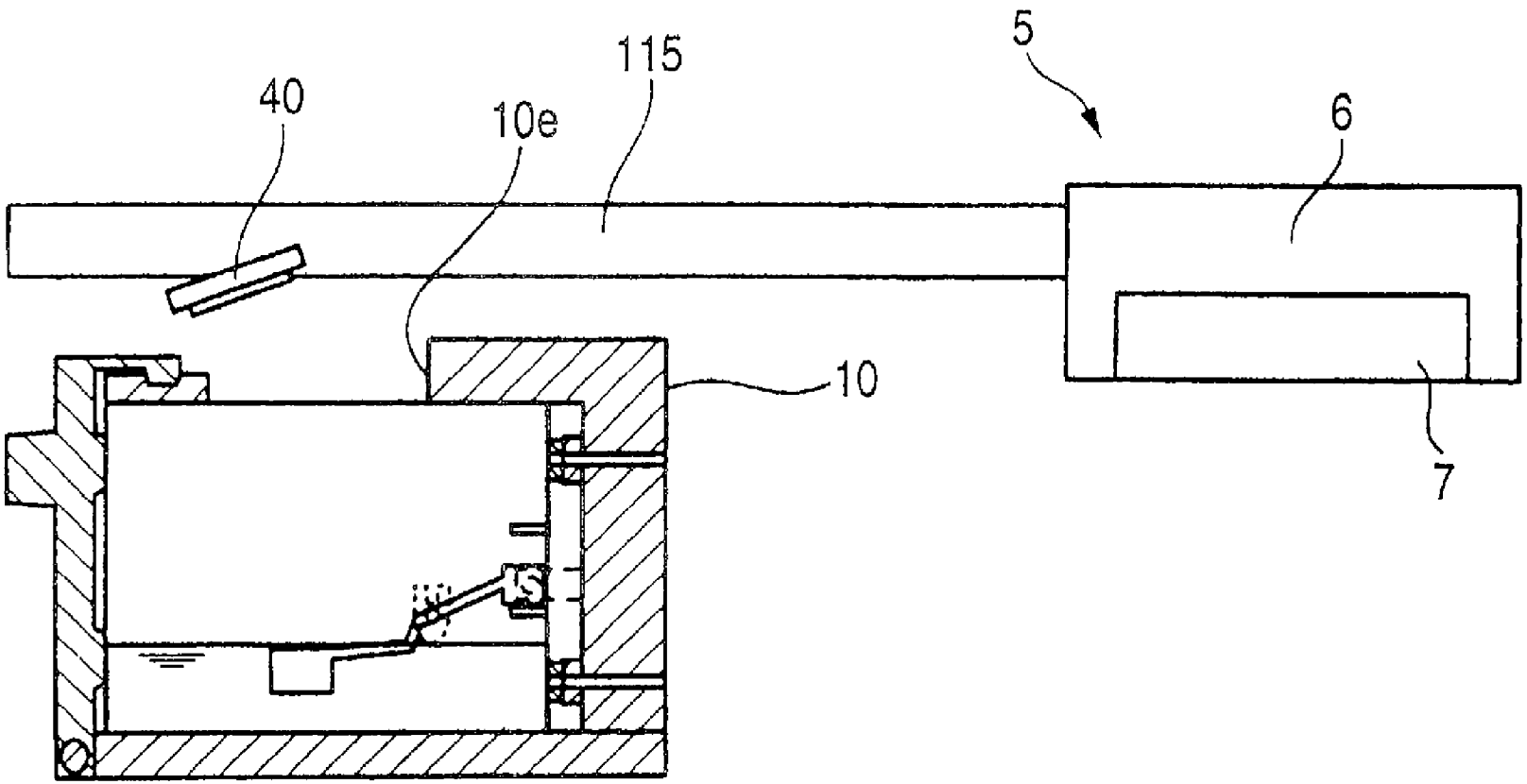
FIG. 6 is a diagram showing a modified example of an installation position of a camera.

For example, in the above-described exemplary embodiments, the cameras 40 are provided to the holder 10. However, the cameras 40 may not be provided to the holder 10, but provided at any positions at which it is possible to obtain an image(s) of the ink surfaces in the ink cartridges 11*a* to 11*d*. As one example, as shown in FIG. 6, the holder 10 may be disposed below the carriage 5, and a camera holder 115 may extend from the carriage 5. A single camera 40 may be attached to the camera holder 115 at a position directly above an opening 10*e* formed at the top of the holder 10. Since the camera holder 115 and the camera 40 moves along with the carriage 5, it is possible to selectively obtain images of the ink liquid surfaces in the four ink cartridges 11*a* to 11*d* via the opening 10*e*. Further, it is possible for the camera 40 to obtain an image of other components of the inkjet printer 1 within the movable range of the carriage 5. For example, by obtaining an image of the ink absorbing member 14, it is possible to check how much ink is absorbed in the ink absorbing member 14.

Figure 7:
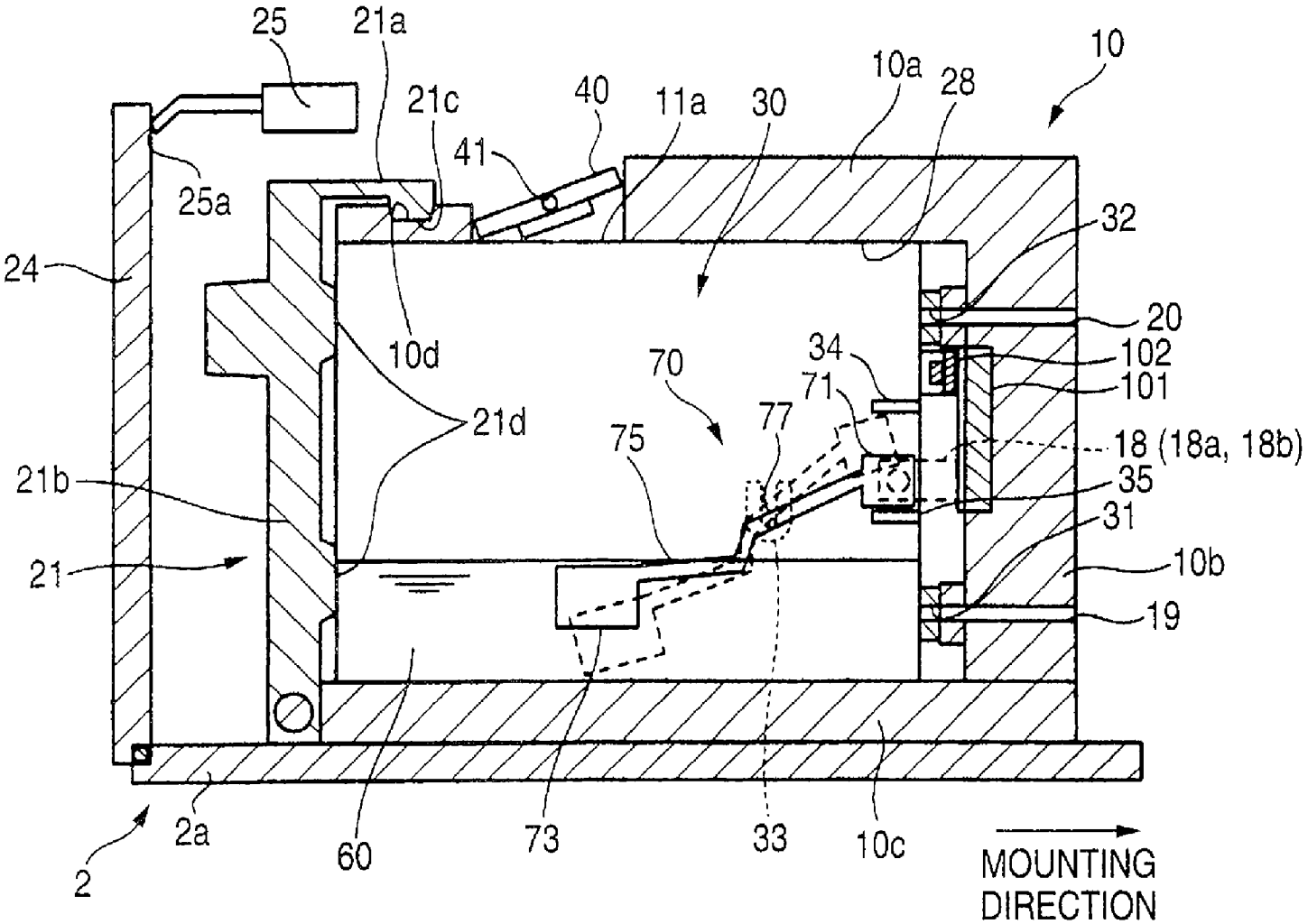
FIG. 7 is a diagram showing another modified example of an installation position of an illumination unit.

Further, in the above-described exemplary embodiments, the illumination unit 44 is provided to the camera 40. However, when external light is bright enough to visually check the ink surface in the ink cartridges 11*a* to 11*d*, the illumination unit 44 may be omitted. Further, an illumination unit may be provided to another position separated from the camera 40. For example, as shown in FIG. 7, illumination units 102 may be provided at the leading walls of the respective cases 60 of the ink cartridges 11*a* to 11*d* so as to illuminate the insides of the ink tanks 30. Further, a power supply unit 101 is provided at the side wall portion 10*b* of the holder 10 at the closed end of the cartridge mounting section 28. When the ink cartridges 11*a* to 11*d* are mounted on the respective cartridge mounting sections 28, the illumination units 102 and the power supply unit 101 are electrically connected. Then, the illumination units 102 are supplied with electric power from the power supply unit 101, and illuminate the inside of the ink tanks 30 in accordance with control signals from the controller 50. For example, when a user operates the operation unit 91 to obtain the images of the ink surfaces with the cameras 40, the illumination units 102 illuminate the insides of the ink tanks 30 in response to receptions of control signals from the controller 50, respectively. In addition, the illumination unit 102 may illuminate the inside of the ink tank 30 when the cover opening and closing detection sensor 25 detects that the cover 24 is opened. Moreover, a window formed of a transparent material may be provided at the cover unit 21. When the ink tanks 30 are illuminated by the illumination units 102 from the closed end of the cartridge mounting sections 2B, it is possible to visually check the remaining amounts of inks in the ink cartridges 11*a* to 11*d* from the window of the cover unit 21, respectively, without removing the ink cartridges 11*a* to 11*d* from the holder 10. That is, by providing the illumination unit 102, it becomes easier to check the remaining amounts of inks in the ink cartridges 11*a* to 11*d* even without using a camera, compared with a case where the illumination unit is not provided.

Moreover, in the above-described exemplary embodiments, the bottom of the case 60 may not have translucency, but may have a color with high contrast opposite to a color of the stored ink. For example, an ink cartridge storing black ink may have a white bottom, an ink cartridge storing yellow ink may have a black bottom, an ink cartridge storing a magenta ink may have a yellow bottom, and an ink cartridge storing a cyan ink may have a yellow bottom. That is, bottom colors of the cases 60 may be varied in accordance with the inks stored therein. In other words, at least one inner surface of the case 60 may have a color with high contrast opposite to a color of the stored ink. Additionally, each of the cases 60 has a wall through which a user can see the ink or a camera obtains an image of the at least one surface. In accordance with this configuration, it is easy to check the ink surfaces when images of the ink surfaces in the ink cartridges 11*a* to 11*d* are obtained by the camera 40. Further, the case 60 may be formed of a water repellent material, or a water repelling treatment may be applied to the inside of the case 60. In accordance with this configuration, ink may not permeate the inner wall surface of the case 60, and therefore, it is easy to check the ink surface when the ink surface in the ink cartridge 11*a* is imaged by the camera 40.

Further, in the above-described exemplary embodiments, the holder 10 is fixed to the frame 2. However, the holder 10 may not be fixed to the frame 2, but located at any position, e.g., on the carriage 5.

Additionally, in the above-described exemplary embodiments, the images obtained by the camera 40 are displayed on the display unit 92. However, the images may be displayed on a display of an external device such as a Personal Computer.

Moreover, in the above-described exemplary embodiments, the camera 40 obtains an image in response to the user operating the operation unit 91. However, the camera 40 may obtain an image not only in response to an operation of the operation unit 91, but also in response to an operation of an external device such as a Personal Computer, or at intervals of a predetermined time.

Further, in the above-described exemplary embodiments, the camera 40 obtains images of the ink surfaces as still images. However, the images are not limited to still images, and the ink surfaces may be obtained as video pictures by a Charge Coupled Device (CCD) camera, a Complementary Metal-Oxide Semiconductor (CMOS) camera, or the like. It is possible for a user to check the remaining amounts of inks in real time by displaying the video pictures on the display unit 92 or the like.

Additionally, in the above-described exemplary embodiments, when it is detected that the remaining amount of ink is low by the optical sensor 18, the camera 40 obtains an enlarged image of the ink surface with using the zoom function. However the camera 40 may obtain an enlarged image of the ink surface with using the zoom function not only when the optical sensor 18 detects the low remaining amount of ink, but also when a user operates the operation unit 91.

Moreover, in the above-described exemplary embodiments, the ink cartridges 11*a* to 11*d* are mounted onto the cartridge mounting sections 28 in the horizontal direction. However, the inventive concept of the present invention can be applied even when the ink cartridges 11*a* to 11*d* are mounted onto the cartridge mounting sections 28 from above, in which the cameras 40 may be provided at the side wall portion 10*b* of the holder 10, for example.

What is claimed is:

1. An inkjet printer comprising:

a holder configured to mount thereon an ink cartridge for storing an ink; and an imaging unit which obtains an image of a surface of the ink in the ink cartridge mounted on the holder, wherein the holder is configured so that the ink cartridge is mounted thereonto along a mounting direction which is substantially parallel to a horizontal direction, wherein the ink cartridge includes a leading wall from which the ink cartridge is mounted onto the holder, wherein the ink cartridge includes an ink outlet part, wherein the ink outlet part is provided at a lower portion of the leading wall, and wherein the imaging unit is provided above the ink cartridge mounted on the holder and directed to the leading wall while being inclined with respect to a vertical direction by a predetermined angle.

2. The inkjet printer according to claim 1, wherein the imaging unit is attached to the holder.

3. The inkjet printer according to claim 1, wherein the imaging unit is configured to obtain the image of the surface of the ink disposed at least at the ink outlet part.

4. The inkjet printer according to claim 1, wherein the imaging unit has a zoom function to vary a focal length of a lens of the imaging unit.

5. The ink jet printer according to claim 4 further comprising a detector which detects a remaining amount of the ink in the ink cartridge, wherein the ink cartridge includes an ink outlet part, and, wherein, when the detector detects that the remaining amount of the ink is less than a predetermined amount, the imaging unit obtains an enlarged image of the surface of the ink disposed in a vicinity of the ink outlet part with using the zoom function.

6. The inkjet printer according to claim 1, further comprising a frame, wherein the holder is fixed to the frame.

7. The inkjet printer according to claim 1, further comprising a display unit which displays the image obtained by the imaging unit.

8. The inkjet printer according to claim 1, further comprising an illumination unit which illuminates an inside of the ink cartridge mounted on the holder.

9. The inkjet printer according to claim 8, wherein the illumination unit illuminates the inside of the ink cartridge when the imaging unit obtains the image.

10. The inkjet printer according to claim 1, wherein the holder includes a plurality of cartridge mounting sections configured to mount thereon a plurality of ink cartridges, respectively, the plurality of cartridge mounting sections being aligned in a predetermined direction, wherein the imaging unit is provided at a substantially center part of the plurality of cartridge mounting sections in the predetermined direction, and wherein the imaging unit obtains images of surfaces of inks in the plurality of ink cartridges mounted on the plurality of cartridge mounting sections, respectively, at the same time.

11. The inkjet printer according to claim 1, wherein the holder includes a plurality of cartridge mounting sections configured to mount thereon a plurality of ink cartridges, respectively, the plurality of cartridge mounting sections being aligned in a predetermined direction, the inkjet printer further comprising a moving unit which moves the imaging unit along the predetermined direction.

12. An inkjet printer comprising:

a holder configured to mount thereon an ink cartridge for storing an ink;

an illumination unit configured to illuminate an inside of the ink cartridge mounted on the holder; and a power supply unit configured to supply electric power, wherein the illumination unit is electrically connected to the power supply unit and the power supply unit supplies power to the illumination unit, only when the ink cartridge is mounted to the holder, such that the illumination unit then illuminates the inside of the ink cartridge.

13. The ink cartridge according to claim 1, wherein the imaging unit is positioned internally of the inkjet printer.

14. The ink cartridge according to claim 1, wherein the imaging unit is positioned at a wall of the holder.

15. An inkjet printer comprising:

a holder configured to mount thereon an ink cartridge for storing an ink; and an imaging unit which obtains an image of a surface of the ink in the ink cartridge mounted on the holder, wherein the holder includes a plurality of cartridge mounting sections configured to mount thereon a plurality of ink cartridges, respectively, the plurality of cartridge mounting sections being aligned in a predetermined direction, wherein the imaging unit is provided at a substantially center part of the plurality of cartridge mounting sections in the predetermined direction, and wherein the imaging unit obtains images of surfaces of inks in the plurality of ink cartridges mounted on the plurality of cartridge mounting sections, respectively, at the same time.

16. An inkjet printer comprising:

a holder configured to mount thereon an ink cartridge for storing an ink; and an imaging unit which obtains an image of a surface of the ink in the ink cartridge mounted on the holder, wherein the holder includes a plurality of cartridge mounting sections configured to mount thereon a plurality of ink cartridges, respectively, the plurality of cartridge mounting sections being aligned in a predetermined direction, the inkjet printer further comprising a moving unit which moves the imaging unit along the predetermined direction.

* * * * *